US009334875B2

(12) United States Patent
Sato et al.

(10) Patent No.: US 9,334,875 B2
(45) Date of Patent: May 10, 2016

(54) MULTIBLADE CENTRIFUGAL FAN AND AIR CONDITIONER EQUIPPED WITH THE SAME

(75) Inventors: Seiji Sato, Tokyo (JP); Tsuyoshi Eguchi, Tokyo (JP); Atusi Suzuki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 700 days.

(21) Appl. No.: 13/806,003

(22) PCT Filed: Oct. 20, 2011

(86) PCT No.: PCT/JP2011/074179
§ 371 (c)(1),
(2), (4) Date: Dec. 20, 2012

(87) PCT Pub. No.: WO2012/056990
PCT Pub. Date: May 3, 2012

(65) Prior Publication Data

US 2013/0092357 A1 Apr. 18, 2013

(30) Foreign Application Priority Data

Oct. 25, 2010 (JP) ..... 2010-238826

(51) Int. Cl.
*F04D 29/44* (2006.01)
*F04D 29/42* (2006.01)
(Continued)

(52) U.S. Cl.
CPC ..... *F04D 29/4226* (2013.01); *F04D 29/403* (2013.01); *F04D 29/441* (2013.01);
(Continued)

(58) Field of Classification Search
CPC . F04D 29/4226; F04D 29/441; F04D 29/002; F04D 29/403; F04D 29/4206; F04D 29/661; F05D 2260/96
See application file for complete search history.

(56) References Cited

U.S. PATENT DOCUMENTS 5,141,397 A 8/1992 Sullivan
5,257,904 A 11/1993 Sullivan
(Continued)

FOREIGN PATENT DOCUMENTS

JP 60-145497 A 7/1985
JP 64-008199 B2 2/1989
(Continued)

OTHER PUBLICATIONS

Chinese Office Action dated Oct. 28, 2014, issued in corresponding CN Application No. 201180031471.3 with English translation (11 pages).
(Continued)

*Primary Examiner* — Ninh H Nguyen
(74) *Attorney, Agent, or Firm* — Westerman, Hattori, Daniels & Adrian, LLP

(57) ABSTRACT

Provided are a low-noise, high-performance multiblade centrifugal fan that suppresses interference between rotational flows generated within extension sections that are extended in a rotation-axis direction at upper and lower end surfaces of a scroll casing, and an air conditioner equipped with the same. In a multiblade centrifugal fan having an impeller disposed in a rotatable manner about a rotation shaft within a scroll casing having a flow path whose cross section gradually increases in a rotational direction, at least one of upper and lower end surfaces of the scroll casing serves as an inclined end surface that is extended in the extending direction of the rotation shaft such that an extended height thereof gradually increases in the rotational direction from a scroll start position, and a stepped section extending in the rotational direction is provided between the inclined end surface and an inner-peripheral side surface of an extension section.

7 Claims, 5 Drawing Sheets

(51) Int. Cl.

| | |
|---|---|
| ***F04D 29/40*** | (2006.01) |
| ***F04D 29/66*** | (2006.01) |
| ***F28F 13/12*** | (2006.01) |
| *F24F 1/00* | (2011.01) |
| *F24F 13/24* | (2006.01) |

(52) U.S. Cl.
CPC ..... *F04D29/661* (2013.01); *F28F 13/12* (2013.01); *F05D 2260/96* (2013.01); *F24F 1/0022* (2013.01); *F24F 13/24* (2013.01)

(56) References Cited

U.S. PATENT DOCUMENTS

| | | | | |
|---|---|---|---|---|
| 5,281,092 | A | 1/1994 | Sullivan | |
| 5,474,422 | A | 12/1995 | Sullivan | |
| 5,839,879 | A | 11/1998 | Kameoka et al. | |
| 6,604,906 | B2 * | 8/2003 | Ozeki | F04D 25/082 415/204 |
| 6,802,699 | B2 * | 10/2004 | Mikami | F04D 29/4226 310/62 |
| 7,179,051 | B2 * | 2/2007 | Williams | F04D 29/624 415/204 |
| 7,748,954 | B2 * | 7/2010 | Eguchi | F04D 29/162 415/119 |
| 8,973,576 | B2 * | 3/2015 | Kenyon | A61M 16/0066 128/204.18 |
| 2006/0239815 | A1 | 10/2006 | Hanai | |

FOREIGN PATENT DOCUMENTS

| | | | |
|---|---|---|---|
| JP | 4-269399 | A | 9/1992 |
| JP | 9-158898 | A | 6/1997 |
| JP | 11-091334 | A | 4/1999 |
| JP | 3785758 | B2 | 6/2006 |
| JP | 2006-299965 | A | 11/2006 |
| JP | 4435713 | B2 | 3/2010 |

OTHER PUBLICATIONS

Japanese Decision to Grant a Patent dated Oct. 7, 2014, issued in corresponding JP application No. 2010-238826 (3 pages). Explanation of relevance: The Decision to Grant a Patent has been received.

Japanese Office Action dated Mar. 25, 2014, issued in corresponding Japanese Patent Application No. 2010-238826 with English translation(5 pages).

International Search Report for PCT/JP2011/074179, mailing date of Jan. 24, 2012.

A Notification of the Grant of Patent Right for Invention dated Jan. 26, 2016, issued in counterpart Chinese Patent Application No. 201180031471.3. Explanation of Relevance: The Notification of Grant of Invention Patent has been received. With English translation. (2 pages).

* cited by examiner

MULTIBLADE CENTRIFUGAL FAN AND AIR CONDITIONER EQUIPPED WITH THE SAME

TECHNICAL FIELD

The present invention relates to a multiblade centrifugal fan having a scroll casing and an impeller provided within the scroll casing in a manner allowing rotation, and to an air conditioner equipped with the same.

BACKGROUND ART

A multiblade centrifugal fan in which an impeller having a plurality of blades is disposed in such a manner as to be rotatable via a motor within a scroll-shaped casing with a tongue section thereof serving as a base point is widely used as an air-blowing fan in refrigerators, air conditioners, or ventilators (which will simply be referred to as "air conditioners" hereinafter). In such a multiblade centrifugal fan, air taken in through an inlet, provided at an upper end surface of the scroll casing, in the axial direction is deflected in the centrifugal direction (i.e., the radial direction) from the inner periphery toward the outer periphery as it passes between the blades of the impeller. The air is pressure-fed so as to be blown from the impeller to an air flow path within the scroll casing. Subsequently, the air is delivered in the rotational direction along the inner peripheral surface of the scroll casing so as to be blown outside via an outlet.

In the aforementioned multiblade centrifugal fan, in order to recover the dynamic pressure of the air flowing through the scroll casing in the rotational direction of the impeller, the scroll casing has the shape of a scroll with an outer diameter that gradually increases in the rotational direction. In recent years, in order to make the casing as compact as possible, the casing is extended in the rotation-axis direction such that the cross section of the flow path gradually increases in the rotational direction. In such a multiblade centrifugal fan, the air blown into the scroll casing from the entire perimeter of the impeller is not completely deflected within the impeller, but is blown downward at an angle lopsidedly toward a lower end surface of the scroll casing, and then flows in the rotational direction. In this case, the air is blown toward the outlet while generating rotational flows (vortex flows) proceeding toward the inner periphery at the upper and lower sides of the flow path when viewed in cross section.

In particular, with regard to the rotational flow generated at the lower end surface opposite the upper end surface provided with the inlet in the scroll casing, when the flow proceeding toward the inner periphery above the lower end surface strikes an inner-peripheral side surface of an extension section extended in the rotation-axis direction and then proceeds toward the upper end surface (i.e., upward), this flow interferes with the airflow from the impeller, causing disturbance in the flow, which results in problems such as increased aerodynamic noise and reduced air-blowing efficiency. Patent Literature 1 proposes an example in which the inner-peripheral side surface of the extension section extended in the rotation-axis direction of the casing is formed as an inclined surface, and a plurality of ribs extended in the rotational direction are provided on this inclined surface. By means of the ribs, a secondary flow proceeding toward the impeller is suppressed, thereby reducing noise.

CITATION LIST

Patent Literature

{PTL 1}
The Publication of Japanese Patent No. 3785758

SUMMARY OF INVENTION

Technical Problem

However, it is difficult to suppress the secondary flow by simply providing the ribs as in Patent Literature 1. On the other hand, if the secondary flow is to be suppressed by increasing the height of the ribs, the disturbance in the flow would become greater at the rear side of the ribs, which is a problem in that it is not necessarily possible to achieve a desired noise reducing effect or improved air-blowing efficiency by reducing the disturbance in the airflow.

The present invention has been made in view of these circumstances, and an object thereof is to provide a low-noise, high-performance multiblade centrifugal fan that suppresses interference between rotational flows generated within extension sections that are extended in a rotation-axis direction at upper and lower end surfaces of a scroll casing, and an air conditioner equipped with the same.

Solution to Problem

In order to solve the aforementioned problems, a multiblade centrifugal fan and an air conditioner equipped with the same according to the present invention employ the following solutions.

In a multiblade centrifugal fan according to a first aspect of the invention having an impeller disposed in a rotatable manner about a rotation shaft within a scroll casing having a flow path whose cross section gradually increases in a rotational direction, at least one of upper and lower end surfaces of the scroll casing serves as an inclined end surface that is extended in a rotation-axis direction such that an extended height thereof gradually increases in the rotational direction from a scroll start position of the scroll casing, and at least one stepped section extending in the rotational direction is provided between the inclined end surface and an inner-peripheral side surface of an extension section.

In the multiblade centrifugal fan according to the first aspect of the invention, at least one of the upper and lower end surfaces of the scroll casing serves as an inclined end surface that is extended in the rotation-axis direction such that the extended height thereof gradually increases in the rotational direction from the scroll start position of the scroll casing, and at least one stepped section extending in the rotational direction is provided between the inclined end surface and the inner-peripheral side surface of the extension section. Due to air blown centrifugally from the impeller, a rotational flow (vortex flow) proceeding toward the inner periphery is generated above the inclined end surface in the extension section extended in the rotation-axis direction of the scroll casing. With the stepped section, the rotational flow can be immobilized and made stable within the extension section, which is located at the outer peripheral side of the stepped section and distant from the impeller. Consequently, interference between the airflow from the impeller and the rotational flow is suppressed so that an increase in noise and a reduction in efficiency caused by disturbance in the airflow are suppressed, thereby achieving a low-noise, high-performance multiblade centrifugal fan.

In the multiblade centrifugal fan according to the first aspect of the invention, the lower end surface opposite the upper end surface that is provided with an inlet in the scroll casing may serve as the inclined end surface that is extended in the rotation-axis direction such that the extended height thereof gradually increases in the rotational direction, and the stepped section may be provided between the inclined end surface and the inner-peripheral side surface of the extension section.

In this configuration, the lower end surface opposite the upper end surface that is provided with the inlet in the scroll casing serves as the inclined end surface that is extended in the rotation-axis direction such that the extended height thereof gradually increases in the rotational direction, and the stepped section is provided between the inclined end surface and the inner-peripheral side surface of the extension section. The air blown from the impeller in particular tends to flow lopsidedly toward the lower end surface than toward the upper end surface provided with the inlet. With the stepped section, a large and intense rotational flow proceeding toward the inner periphery and generated above the inclined end surface in the extension section at the lower end surface thereof due to this airflow can be immobilized and made stable within the extension section, which is located at the outer peripheral side of the stepped section and distant from the impeller. Consequently, interference between the airflow from the impeller and the rotational flow is suppressed at the lower end surface of the scroll casing where disturbance in the airflow tends to occur in particular, so that an increase in noise and a reduction in efficiency caused by disturbance in the airflow are suppressed, thereby achieving a low-noise, high-performance multiblade centrifugal fan.

In the multiblade centrifugal fan according to the first aspect of the invention, each of the upper and lower end surfaces of the scroll casing may serve as the inclined end surface that is extended in the rotation-axis direction such that the extended height thereof gradually increases in the rotational direction, and the stepped section may be provided between each inclined end surface and the inner-peripheral side surface of the extension section.

In this configuration, each of the upper and lower end surfaces of the scroll casing serves as the inclined end surface that is extended in the rotation-axis direction such that the extended height thereof gradually increases in the rotational direction, and the stepped section is provided between each inclined end surface and the inner-peripheral side surface of the extension section. Due to the air blown from the impeller, rotational flows proceeding toward the inner periphery are generated at the inclined end surfaces within the upper and lower extension sections extended in the rotation-axis direction of the scroll casing. With the stepped sections, the rotational flows can be immobilized and made stable within the extension sections, which are located at the outer peripheral side of the stepped sections and distant from the impeller. Consequently, interference between the airflow from a hub side and a shroud side of the impeller and the rotational flows is suppressed so that an increase in noise and a reduction in efficiency caused by disturbance in the airflow are suppressed, thereby achieving a low-noise, high-performance multiblade centrifugal fan.

In the aforementioned multiblade centrifugal fan, the stepped section may have a height and a width that gradually increase from an inclination start position of the inclined end surface toward a position in front of a tongue section of the scroll casing.

In this configuration, the stepped section has a height and a width that gradually increase from the inclination start position of the inclined end surface toward the position in front of the tongue section of the scroll casing. By gradually increasing the height and the width of the stepped section relative to the extension section that is extended such that the extended height thereof gradually increases in the rotational direction, the rotational flow that gradually grows due to the airflow gradually increasing in size in the rotational direction can be immobilized and made stable within the extension section, which is located at the outer peripheral side of the stepped section and distant from the impeller, by the stepped section having an appropriate size for the rotational flow. Consequently, interference between the airflow from the impeller and the rotational flow is effectively suppressed so that an increase in noise and a reduction in efficiency caused by disturbance in the airflow are suppressed, thereby achieving a low-noise, high-performance multiblade centrifugal fan.

In the aforementioned multiblade centrifugal fan, the stepped section may gradually decrease in size in a diffuser section formed in an outlet of the scroll casing, and the stepped section may vanish at an exit of the diffuser section.

In this configuration, the stepped section gradually decreases in size in the diffuser section formed in the outlet of the scroll casing, and the stepped section vanishes at the exit of the diffuser section. Therefore, in the diffuser section in the outlet from which the airflow from the impeller is released, the stepped section is gradually decreased in size so that the stepped section vanishes at the exit of the diffuser section, whereby the cross section of the flow path can be effectively increased. Thus, a dynamic-pressure recovery effect can be maximized in the scroll casing having required dimensions, thereby achieving improved fan performance.

In the aforementioned multiblade centrifugal fan, an upper surface of the stepped section may be downwardly inclined toward an outer periphery.

In this configuration, the upper surface of the stepped section is downwardly inclined toward the outer periphery so that, even when the air blown from the impeller flows downward at an angle relative to the lower end surface of the scroll casing, the angle of the air flowing near the upper surface of the stepped section can be made substantially equal to the angle of the upper surface of the stepped section, whereby the downwardly blown air can be made stable near the upper surface of the stepped section. Therefore, disturbance in the airflow occurring as a result of providing the stepped section is prevented so that an increase in noise and a reduction in performance can be suppressed.

In the aforementioned multiblade centrifugal fan, the stepped section may be provided with an even number of steps.

In this configuration, the stepped section is provided with an even number of steps. Therefore, by providing the stepped section with an even number of steps, vortex flows are generated at the corners of the steps by a secondary flow of the rotational flow generated within the extension section located at the outer peripheral side of the outermost step. Of the vortex flows, the vortex flow generated at a position closest to the impeller can proceed in the same direction as the airflow from the impeller. Therefore, the vortex flows can be made stable, and disturbance in the airflow from the impeller can be suppressed, thereby achieving a low-noise, high-performance multiblade centrifugal fan.

An air conditioner according to a second aspect of the invention has the aforementioned multiblade centrifugal fan installed therein as an air-blowing fan.

According to the present invention, since the aforementioned low-noise, high-performance multiblade centrifugal fan is installed as an air-blowing fan in the air conditioner, higher performance and reduced noise can be similarly achieved in various types of air conditioners for buildings or vehicles, thereby increasing the commercial value thereof.

Advantageous Effects of Invention

In the multiblade centrifugal fan according to the present invention, due to the air blown centrifugally from the impeller, a rotational flow (vortex flow) proceeding toward the inner periphery is generated above the inclined end surface in the extension section extended in the rotation-axis direction of the scroll casing. With the stepped section, the rotational flow can be immobilized and made stable within the extension section, which is located at the outer peripheral side of the stepped section and distant from the impeller. Consequently, interference between the airflow from the impeller and the rotational flow is suppressed so that an increase in noise and a reduction in efficiency caused by disturbance in the airflow are suppressed, thereby achieving a low-noise, high-performance multiblade centrifugal fan.

Because the air conditioner according to the present invention is equipped with the aforementioned low-noise, high-performance multiblade centrifugal fan, higher performance and reduced noise can be similarly achieved in various types of air conditioners for buildings or vehicles, thereby increasing the commercial value thereof.

DESCRIPTION OF EMBODIMENTS

Embodiments of the present invention will be described below with reference to the drawings.

{First Embodiment}

A first embodiment of the present invention will be described below with reference to FIGS. 1 to 4.

Figure 1:
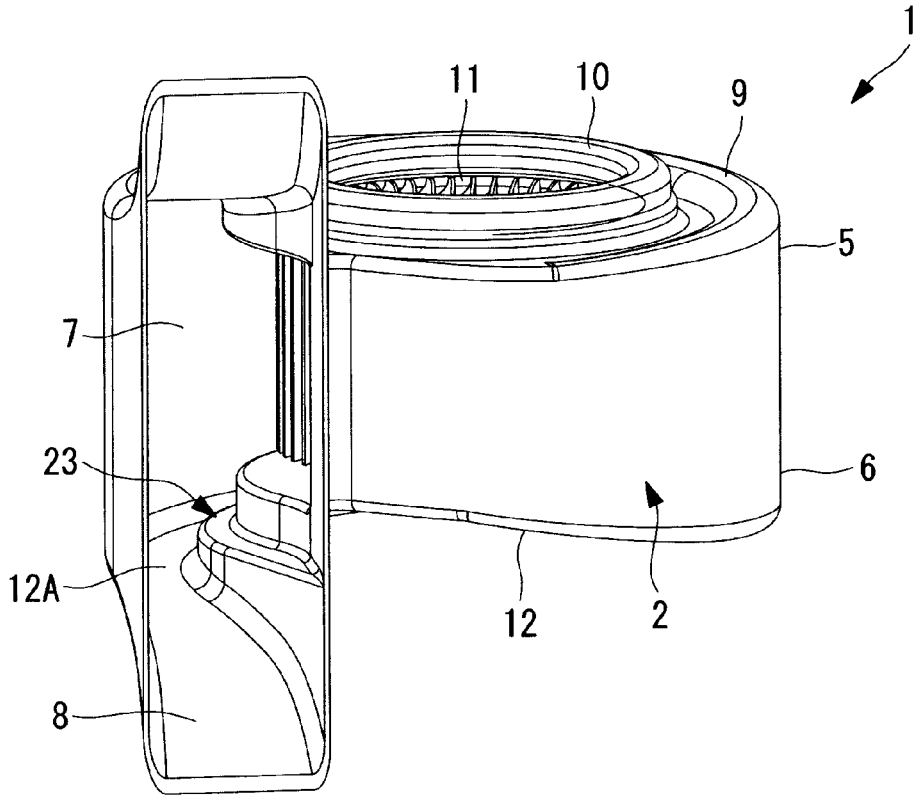
FIG. 1 is a side view of a multiblade centrifugal fan according to a first embodiment of the present invention, as viewed from an outlet thereof.
Figure 2:
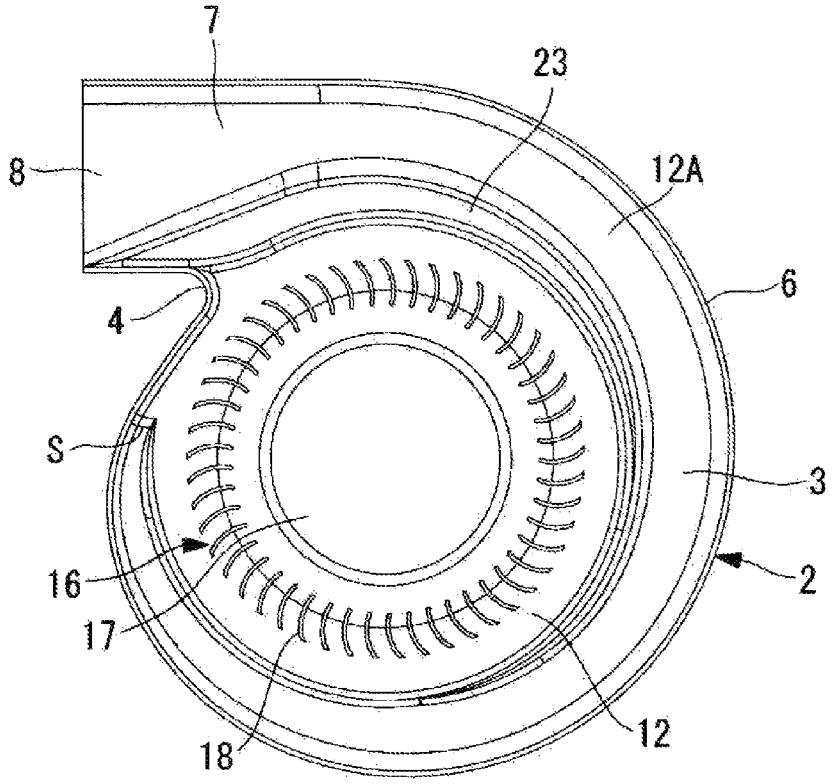
FIG. 2 is a cross-sectional view as viewed from a lower end surface of the multiblade centrifugal fan shown in FIG. 1.
Figure 3:
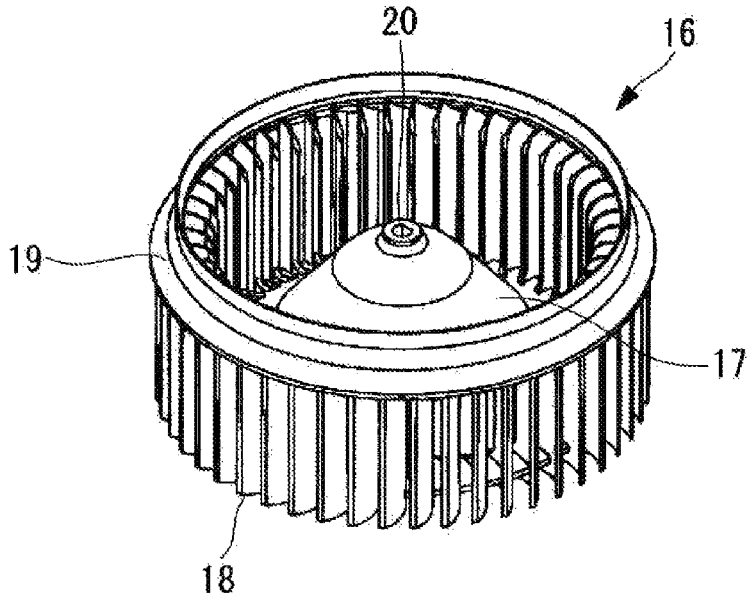
FIG. 3 is a perspective view of an impeller in the multiblade centrifugal fan shown in FIG. 1.
Figure 4:
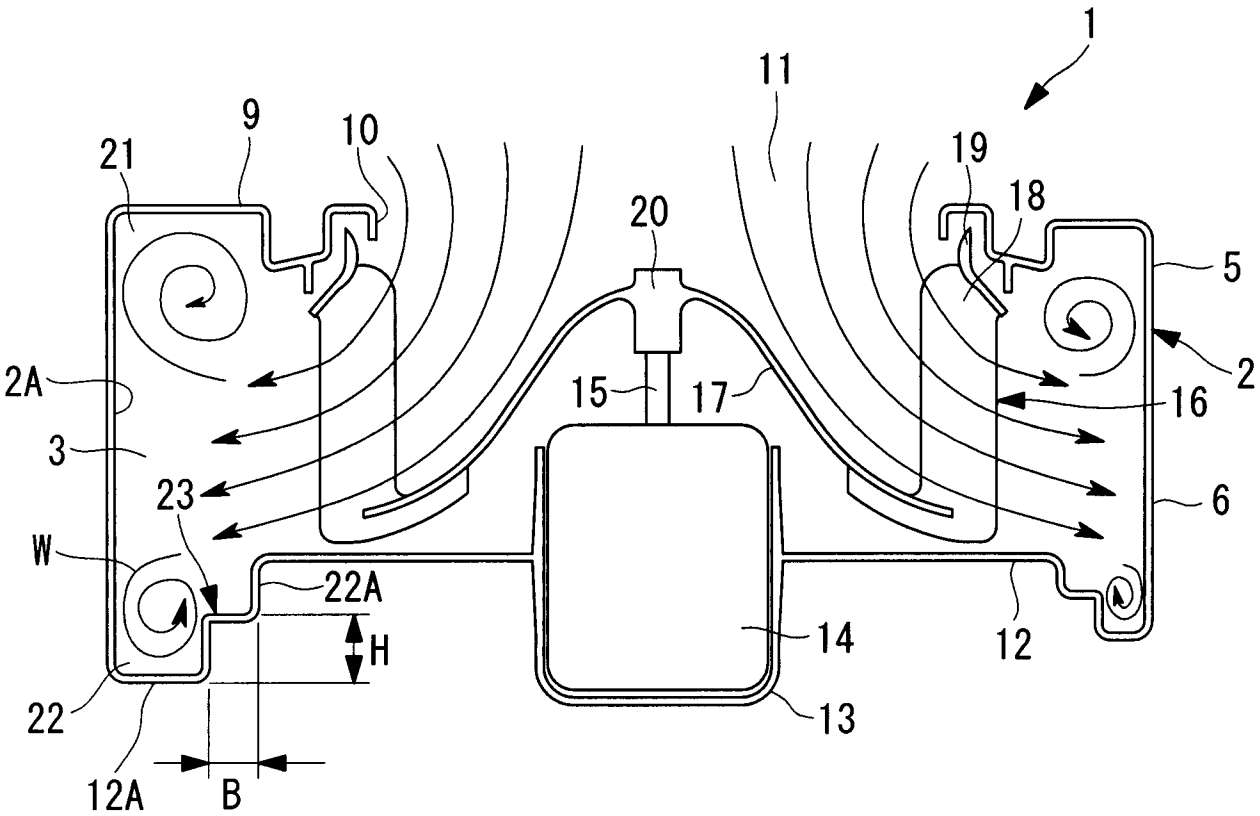
FIG. 4 is a sectional view of the multiblade centrifugal fan shown in FIG. 1, taken along a meridian plane thereof.

FIG. 1 is a side view of a multiblade centrifugal fan according to the first embodiment of the present invention, as viewed from an outlet thereof, FIG. 2 is a cross-sectional view as viewed from a lower end surface thereof, FIG. 3 is a perspective view of an impeller, and FIG. 4 is a sectional view taken along a meridian plane thereof.

A multiblade centrifugal fan 1 includes a plastic scroll casing 2 having the shape of a scroll including a flow path 3 whose cross section gradually increases in the rotational direction.

The scroll casing 2 is formed by joining together a pair of upper and lower plastic casings 5 and 6 having the shape of a scroll with a tongue section 4 serving as a base point, and has an outlet 7 extending tangentially from a terminal end of the scroll. The outlet 7 is provided with a diffuser section 8 in which the flow path 3 sharply enlarges in the vertical direction. An upper end surface 9 of the upper casing 5 is provided with a bell mouth 10, and this bell mouth 10 forms an air inlet 11. As shown in FIG. 4, a lower end surface 12 of the lower casing 6 is provided with a motor installation section 13, and a fan motor 14 having a rotation shaft 15 is accommodated and installed within the motor installation section 13.

An impeller 16 is disposed within the scroll casing 2 in a rotatable manner about the rotation shaft 15. As shown in FIGS. 3 and 4, the impeller 16 includes a disk-shaped hub 17 whose center protrudes toward the inlet, a plurality of blades 18 arranged radially around the outer periphery of the hub 17, and an annular shroud 19 provided at ends, which face the hub 17, of the blades 18. The center of the hub 17 is provided with a boss 20, and the boss 20 is fixed to a shaft end of the rotation shaft 15 so that the impeller 16 is rotationally driven via the fan motor 14. The impeller 16 is composed of plastic.

Furthermore, extension sections 21 and 22 extended in the rotation-axis direction are formed in the outer peripheral areas of the upper and lower end surfaces 9 and 12 of the scroll casing 2. Of the extension sections 21 and 22, the extension section 22 at the lower end surface 12 has an inclined end surface 12A formed by extending the lower end surface 12 in the rotation-axis direction such that the extended height thereof gradually increases in the rotational direction from a scroll start position of the scroll casing 2. The inclined end surface 12A is inclined such that the extended height of the lower end surface 12 gradually increases in the rotational direction from the scroll start position of the scroll casing 2 or from a position S slightly advanced in the rotational direction from that position (see FIG. 1 in which the lower end surface 12 of the scroll casing 2 is inclined).

A stepped section 23 having at least one step extending in the rotational direction is provided between the inclined end surface 12A and an inner-peripheral side surface 22A of the extension section 22. The stepped section 23 is formed such that a height H and a width B thereof gradually increase in the rotational direction from an inclination start position of the inclined end surface 12A toward a position in front of the tongue section 4. The width B of the stepped section 23 is substantially ⅓ of the flow-path width in the extension section 22, and the height H is substantially ½ of the extended height of the extension section 22. The width B and the height H gradually increase as the width and the height of the extension section 22 gradually increase.

As shown in FIGS. 1 and 2, in the diffuser section 8 formed in the outlet 7, the stepped section 23 is formed such that the size of the stepped section 23 gradually decreases from near the tongue section 4 toward an exit of the diffuser section 8, and the stepped section 23 vanishes at the exit of the diffuser section 8.

This embodiment exhibits the following advantages.

When the impeller 16 rotates, air taken in through the inlet 11 in the rotation-axis direction is deflected in the radial direction as it passes between the blades 18 of the impeller 16, and is blown centrifugally from the outer periphery of the impeller 16. The airflow is pressure-fed in the rotational direction through the flow path 3 of the scroll casing 2 during which the flow rate is gradually increased, and at the same time, the dynamic pressure is recovered so that the static pressure is increased, whereby the air is blown outside from the outlet 7.

The air blown centrifugally from the outer periphery of the impeller 16 tends to be blown downward at an angle lopsidedly toward the lower end surface 12 of the scroll casing 2. While being pressure-fed in the rotational direction, a portion of the air generates secondary flows proceeding toward the inner periphery along an outer-peripheral side surface 2A and the upper and lower end surfaces 9 and 12 of the scroll casing 2, whereby rotational flows (vortex flows) W are generated within the upper and lower extension sections 21 and 22, as shown in FIG. 4. Of these rotational flows W, the rotational flow W generated within the extension section 22 at the lower end surface 12 in particular tends to intensify since the air blown from the impeller 16 is blown downward at an angle lopsidedly toward the lower end surface 12 of the scroll casing 2, as mentioned above. Thus, this rotational flow W interferes with the airflow from the impeller 16 and causes disturbance in the flow, possibly leading to increased noise and reduced air-blowing efficiency.

In light of this, the stepped section 23 extending in the rotational direction is provided between the inclined end surface 12A and the inner-peripheral side surface 22A of the extension section 22 in this embodiment. Therefore, with the stepped section 23, the rotational flow (vortex flow) W proceeding toward the inner periphery and generated above the inclined end surface 12A in the extension section 22 can be immobilized and made stable within the extension section 22 located at the outer peripheral side of the stepped section 23 and distant from the impeller 16, as shown in FIG. 4. Consequently, interference between the airflow from the impeller 16 and the aforementioned rotational flow W is suppressed so that an increase in noise and a reduction in efficiency caused by disturbance in the airflow are suppressed, thereby achieving a low-noise, high-performance multiblade centrifugal fan 1. According to this embodiment, it is confirmed that a noise reducing effect of at least 1 dB (A) is achieved based on CFD-based test results.

Furthermore, the height H and the width B of the stepped section 23 gradually increase from the inclination start position S of the inclined end surface 12A toward the position in front of the tongue section 4 of the scroll casing 2. By gradually increasing the height H and the width B of the stepped section 23 relative to the extension section 22 that is extended such that the extended height thereof gradually increases in the rotational direction, the rotational flow W that gradually grows due to the airflow gradually increasing in size in the rotational direction can be immobilized and made stable within the extension section 22, which is located at the outer peripheral side of the stepped section 23 and distant from the impeller 16, by the stepped section 23 having an appropriate size for the rotational flow W. Therefore, interference between the airflow from the impeller 16 and the rotational flow W is effectively suppressed so that an increase in noise and a reduction in efficiency caused by disturbance in the airflow are suppressed, thereby achieving a low-noise, high-performance multiblade centrifugal fan 1.

Furthermore, in this embodiment, the stepped section 23 gradually decreases in size in the diffuser section 8 formed in the outlet 7 of the scroll casing 2, and the stepped section 23 vanishes at the exit of the diffuser section 8. Therefore, in the diffuser section 8 in the outlet 7 from which the airflow from the impeller 16 is released, the stepped section 23 is gradually decreased in size so that the stepped section 23 vanishes at the exit of the diffuser section 8, whereby the cross section of the flow path 3 can be effectively increased. Thus, a dynamic-pressure recovery effect can be maximized in the scroll casing having required dimensions, thereby achieving improved fan performance.

In addition, by installing the aforementioned low-noise, high-performance multiblade centrifugal fan 1 as an air-blowing fan in various types of air conditioners for buildings or vehicles, higher performance and reduced noise can be similarly achieved in the air conditioners, thereby increasing the commercial value thereof.

{Second Embodiment}

Next, a second embodiment of the present invention will be described below with reference to FIG. 5.

This embodiment differs from the first embodiment in that the extension section 21 at the upper end surface 9 is also provided with a stepped section 24. Since the remaining points are the same as those in the first embodiment, descriptions thereof will be omitted.

Figure 5:
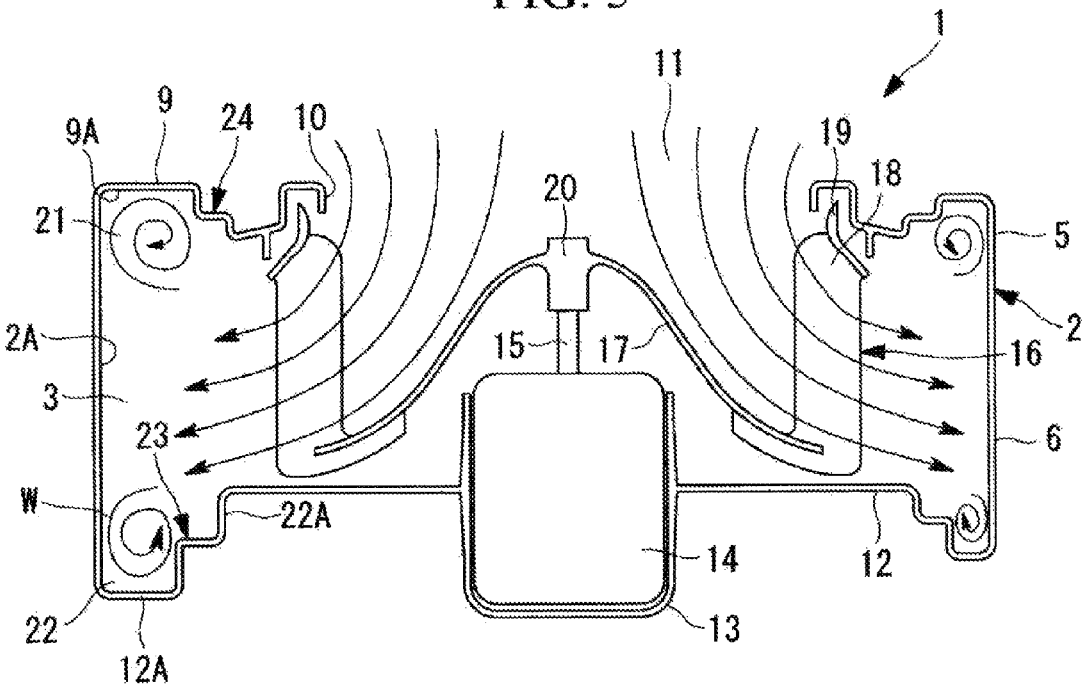
FIG. 5 is a sectional view of a multiblade centrifugal fan according to a second embodiment of the present invention, taken along a meridian plane thereof.

As shown in FIG. 5, in this embodiment, the stepped section 24 that is substantially similar to the stepped section 23 is provided in the extension section 21 at the upper end surface 9 of the scroll casing 2.

With the stepped sections 23 and 24 respectively provided within the extension sections 21 and 22 formed at the upper and lower end surfaces 9 and 12 of the scroll casing 2, the rotational flows (vortex flows) W proceeding toward the inner periphery and respectively generated at an inclined end surface 9A and the inclined end surface 12A in the upper and lower extension sections 21 and 22 by the airflow from the impeller 16 can be immobilized and made stable within the extension sections 21 and 22, which are located at the outer peripheral side of the stepped sections 23 and 24 and distant from the impeller 16, by the stepped sections 23 and 24. Therefore, interference between the airflow from the hub 17 side and the shroud 19 side of the impeller 16 and the rotational flows W is suppressed so that an increase in noise and a reduction in efficiency caused by disturbance in the airflow are suppressed, thereby achieving a low-noise, high-performance multiblade centrifugal fan 1.

{Third Embodiment}

Next, a third embodiment of the present invention will be described below with reference to FIG. 6.

This embodiment differs from the first embodiment in the configuration of a stepped section 25 provided in the extension section 22. Since the remaining points are the same as those in the first embodiment, descriptions thereof will be omitted.

Figure 6:
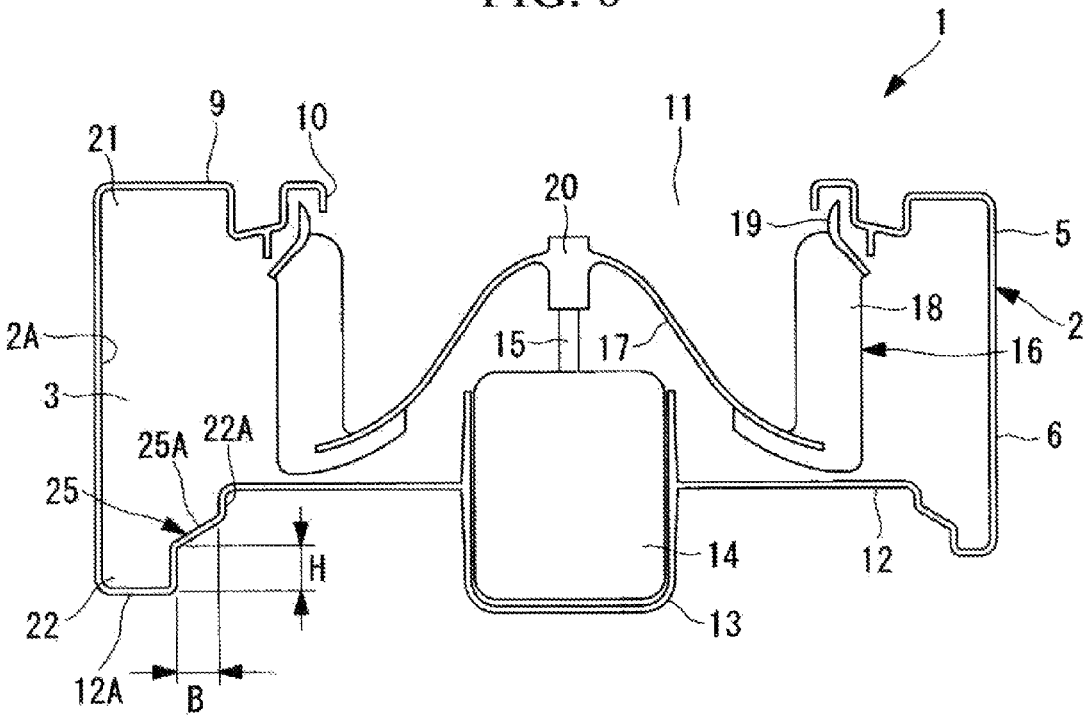
FIG. 6 is a sectional view of a multiblade centrifugal fan according to a third embodiment of the present invention, taken along a meridian plane thereof.

As shown in FIG. 6, in this embodiment, the stepped section 25 provided in the extension section 22 at the lower end surface 12 of the scroll casing 2 has the same height H and the same width B as the stepped section 23 in the first embodiment, but differs therefrom in that an upper surface 25A is downwardly inclined toward the outer periphery.

As described above, the upper surface 25A of the stepped section 25 is downwardly inclined toward the outer periphery so that, even when the air blown from the impeller 16 flows downward at an angle relative to the lower end surface 12 of the scroll casing 2, the angle of the air flowing near the upper surface 25A of the stepped section 25 can be made substantially equal to the angle of the upper surface 25A of the stepped section 25, whereby the downwardly blown air can be made stable near the upper surface 25A of the stepped section 25. Therefore, disturbance in the airflow occurring as a result of providing the stepped section 25 is prevented so that an increase in noise and a reduction in performance can be suppressed.

{Fourth Embodiment}

Next, a fourth embodiment of the present invention will be described below with reference to FIG. 7.

This embodiment differs from the first embodiment in that a stepped section 26 is provided with an even number of steps. Since the remaining points are the same as those in the first embodiment, descriptions thereof will be omitted.

Figure 7:
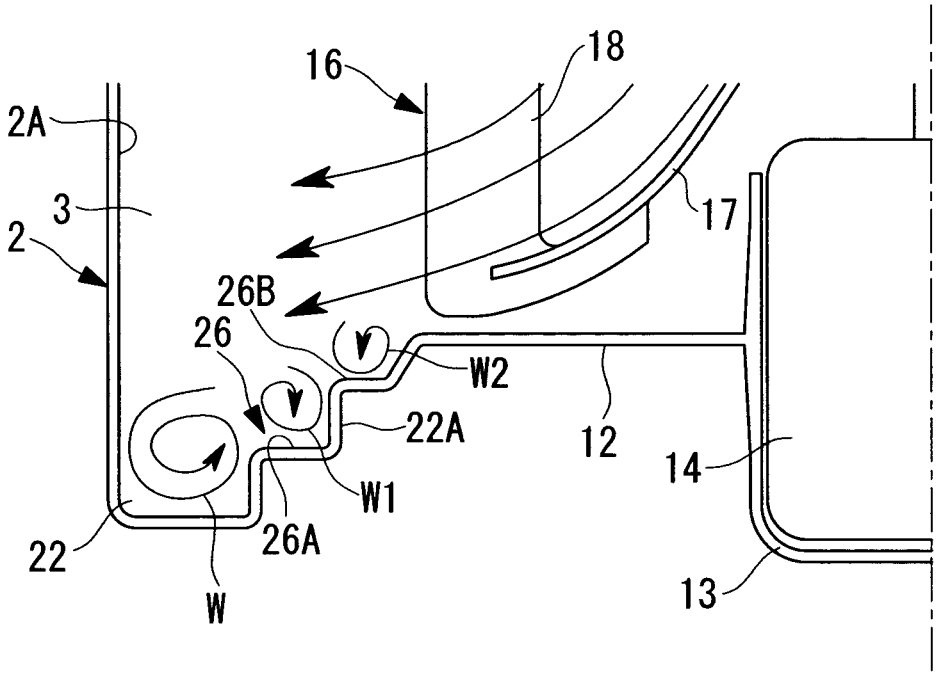
FIG. 7 is a sectional view of a multiblade centrifugal fan according to a fourth embodiment of the present invention, taken along a meridian plane thereof.

As shown in FIG. 7, in this embodiment, the stepped section 26 is provided with an even number of steps, specifically, two steps, i.e., steps 26A and 26B.

By providing the stepped section 26 with the two steps 26A and 26B (i.e., an even number of steps), vortex flows W1 and W2 are generated at the corners of the steps 26A and 26B by a secondary flow of the rotational flow W generated within the extension section 22 located at the outer peripheral side of the outermost step 26A. Of the vortex flows W1 and W2, the vortex flow W2 generated at a position closest to the impeller 16 can proceed in the same direction as the airflow from the impeller 16. Therefore, the vortex flows W, W1, and W2 can be made stable, and disturbance in the airflow from the impeller 16 can be suppressed, thereby achieving a low-noise, high-performance multiblade centrifugal fan 1.

The present invention is not to be limited to the above embodiments, and appropriate modifications are permissible so long as they do not depart from the spirit of the invention. For example, although the extension section 22 at the lower end surface 12 or both the extension sections 21 and 22 at the upper and lower end surfaces 9 and 12 of the scroll casing 2 is/are provided with the stepped section or sections 23, 24, 25, or 26 in the above embodiments, the present invention may include a form in which a stepped section is provided only at the upper end surface of the scroll casing 2.

Furthermore, although the above embodiments are directed to a vertical-type multiblade centrifugal fan 1 in which the rotation shaft 15 extends vertically, the embodiments may similarly be applied to a horizontal-type multiblade centrifugal fan 1 in which the rotation shaft 15 extends horizontally. In that case, the upper and lower end surfaces are replaced by left and right end surfaces.

REFERENCE SIGNS LIST

1 multiblade centrifugal fan
2 scroll casing
3 flow path
4 tongue section
7 outlet
8 diffuser section
9 upper end surface
9A inclined end surface
11 inlet
12 lower end surface
12A inclined end surface
15 rotation shaft
16 impeller
21, 22 extension section
22A inner-peripheral side surface
23, 24, 25, 26, 26A, 26B stepped section
25A upper surface of stepped section
B width of stepped section
H height of stepped section
S inclination start position
W, W1, W2 rotational flow (vortex flow)

The invention claimed is:

1. A multiblade centrifugal fan having an impeller disposed in a rotatable manner about a rotation shaft within a scroll casing having a flow path whose cross section gradually increases in a rotational direction, wherein at least one of upper and lower end surfaces of the scroll casing serves as an inclined end surface that is extended in a rotation-axis direction such that an extended height thereof gradually increases in the rotational direction from a scroll start position of the scroll casing, wherein at least one stepped section extending in the rotational direction is provided between the inclined end surface and an inner-peripheral side surface of an extension section, and wherein the stepped section gradually decreases in size in a diffuser section formed in an outlet of the scroll casing, and the stepped section vanishes at an exit of the diffuser section.

2. The multiblade centrifugal fan according to claim 1, wherein the lower end surface opposite the upper end surface that is provided with an inlet in the scroll casing serves as the inclined end surface that is extended in the rotation-axis direction such that the extended height thereof gradually increases in the rotational direction, and wherein the stepped section is provided between the inclined end surface and the inner-peripheral side surface of the extension section.

3. The multiblade centrifugal fan according to claim 1, wherein each of the upper and lower end surfaces of the scroll casing serves as the inclined end surface that is extended in the rotation-axis direction such that the extended height thereof gradually increases in the rotational direction, and wherein the stepped section is provided between each inclined end surface and the inner-peripheral side surface of the extension section.

4. The multiblade centrifugal fan according to claim 1, wherein the stepped section has a height and a width that gradually increase from an inclination start position of the inclined end surface toward a position in front of a tongue section of the scroll casing.

5. The multiblade centrifugal fan according to claim 1, wherein an upper surface of the stepped section is downwardly inclined toward an outer periphery.

6. The multiblade centrifugal fan according to claim 1, wherein the stepped section is provided with an even number of steps.

7. An air conditioner having the multiblade centrifugal fan according to claim 1 installed therein as an air-blowing fan.

* * * * *